United States Patent [19]

Ross

[11] 4,076,450

[45] Feb. 28, 1978

[54] DOUBLE VOLUTE PUMP WITH REPLACEABLE LIPS

[75] Inventor: Robert R. Ross, San Jose, Calif.

[73] Assignee: United Centrifugal Pumps, San Jose, Calif.

[21] Appl. No.: 648,874

[22] Filed: Jan. 14, 1976

[51] Int. Cl.[2] ..... F04B 7/00

[52] U.S. Cl. ..... 415/197; 51/428; 415/170 A; 417/900

[58] Field of Search ..... 415/53 R, 102, 197, 415/196, 9, 170 R, 170 A, 206–211, 219 A, 219 C, 214, 90; 417/900; 418/178; 51/9 R; 55/406

[56] References Cited

U.S. PATENT DOCUMENTS

| | | | |
|---|---|---|---|
| 1,357,628 | 11/1920 | Elmore | 415/197 |
| 1,989,061 | 1/1935 | Longnecker | 415/53 |
| 3,043,229 | 7/1962 | Atwood, Jr. et al. | 415/204 |
| 3,091,182 | 5/1963 | Anderson et al. | 415/197 |
| 3,191,539 | 6/1965 | Davenport | 415/53 |
| 3,499,388 | 3/1970 | Eberhardt | 415/196 |
| 3,732,028 | 5/1973 | Heynemann et al. | 415/197 |

FOREIGN PATENT DOCUMENTS

| | | | |
|---|---|---|---|
| 802,529 | 9/1936 | France | 415/196 |
| 436,064 | 7/1940 | Italy | 415/204 |
| 13,677 of | 1891 | United Kingdom | 415/197 |
| 12,742 of | 1928 | United Kingdom | 415/196 |
| 1,616 of | 1899 | United Kingdom | 415/196 |
| 825,335 of | 1928 | United Kingdom | 415/196 |

*Primary Examiner*—C. J. Husar
*Attorney, Agent, or Firm*—Robert G. Slick

[57] ABSTRACT

Volute pumps are frequently used for abrasive liquids such as in the transportation of aqueous slurrys of finely divided coal and similar materials. Since pumps for such purposes are very large, they are ordinarily made as double volute pumps to minimize radial thrust. When pumps are used for abrasive materials, the wear on the pump occurs primarily at the volute lips. In accordance with the present invention, a volute pump is provided with replaceable lips so that the lips can be replaced as they become worn. Further, the lips can be made of a much more resistant material than the body of the pump.

5 Claims, 4 Drawing Figures

DOUBLE VOLUTE PUMP WITH REPLACEABLE LIPS

SUMMARY OF THE INVENTION

Volute pumps are frequently used to pump abrasive liquids such as slurrys of finely divided coal. In such cases, a great deal of wear occurs at the lips of the pump. It is often necessary to replace the entire pump casing when only the lips are worn. The wear on volute lips will become even more severe as the peripheral tip speeds of impellers are increased to meet the requirements of high pressure, high volume coal slurry pumps for the anticipated coal and others pipeline industries.

In accordance with the present invention, a pump is provided having replaceable lips so that when the lips become worn, it is only necessary to insert new lips in the pump.

In addition to being replaceable, it is practical to make such lips of a material which is ordinarily not machineable such as ceramics, Stellite, sintered tungsten carbide, or similar hard materials. It would ordinarily be impractical to make the entire casing of the pump of such materials both from the standpoint of difficulty of fabrication and the cost of the materials themselves, but is it entirely practical to make small replaceable parts, such as the lips of the present invention from such materials.

Accordingly, it is the object of the present invention to provide a volute pump with replaceable lips.

It is a further object of the present invention to provide lips which fit into a milled or otherwise formed slot in a pump casing so that the replacement is quick and easy.

Various other objects and features of the invention will be brought out in the balance of the specification.

DESCRIPTION OF THE PREFERRED EMBODIMENTS

Figure 1:
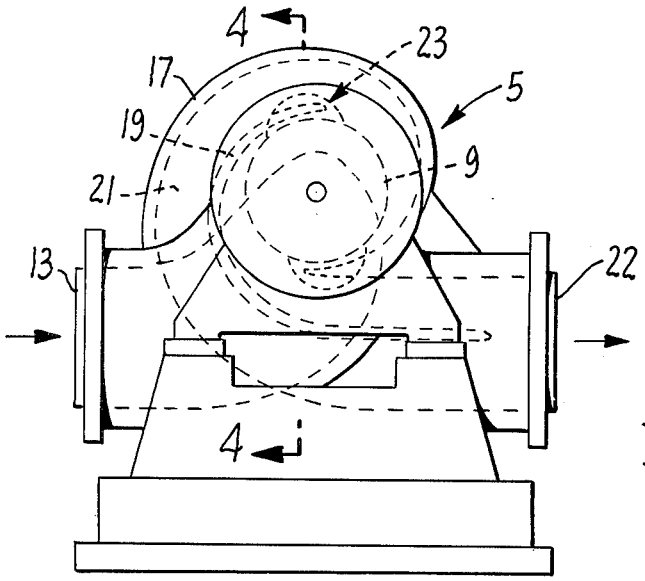
FIG. 1 is a side view of a double volute pump embodying the present invention.
Figure 2:
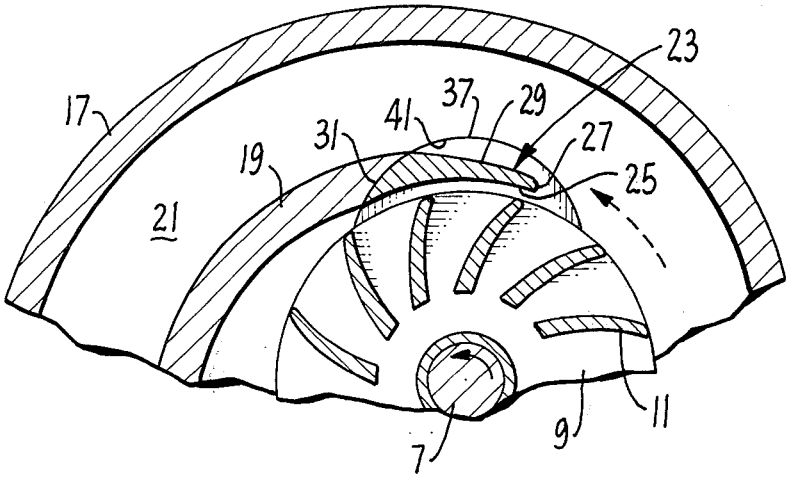
FIG. 2 is an enlarged partial section showing one of the discharge portions of the volute pump of FIG. 1.

Referring now to the drawings by reference characters, there is shown a volute pump 5 having a shaft 7 with an impeller 9 thereon. The impeller 9 is provided with the usual blades 11. The pump has an inlet 13 and inlet passages 15. The casing has an outer wall 17 and an inner wall 19 define double volute passages 21 leading to the pump discharge 22.

Most of the case wear on such a pump takes place at the volute lips.

Figure 3:
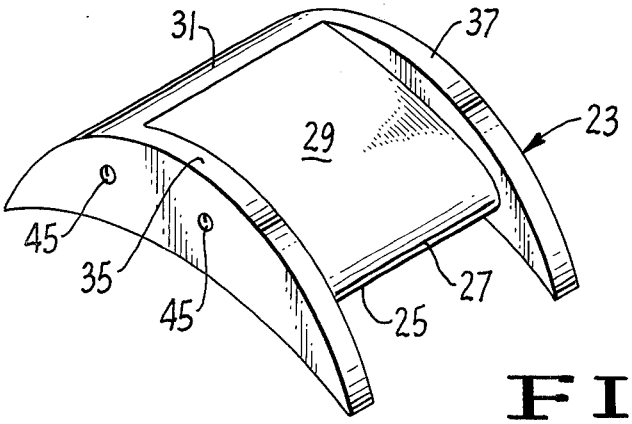
FIG. 3 is an enlarged perspective view of one of the replaceable lips which constitutes the gist of the present invention.
Figure 4:
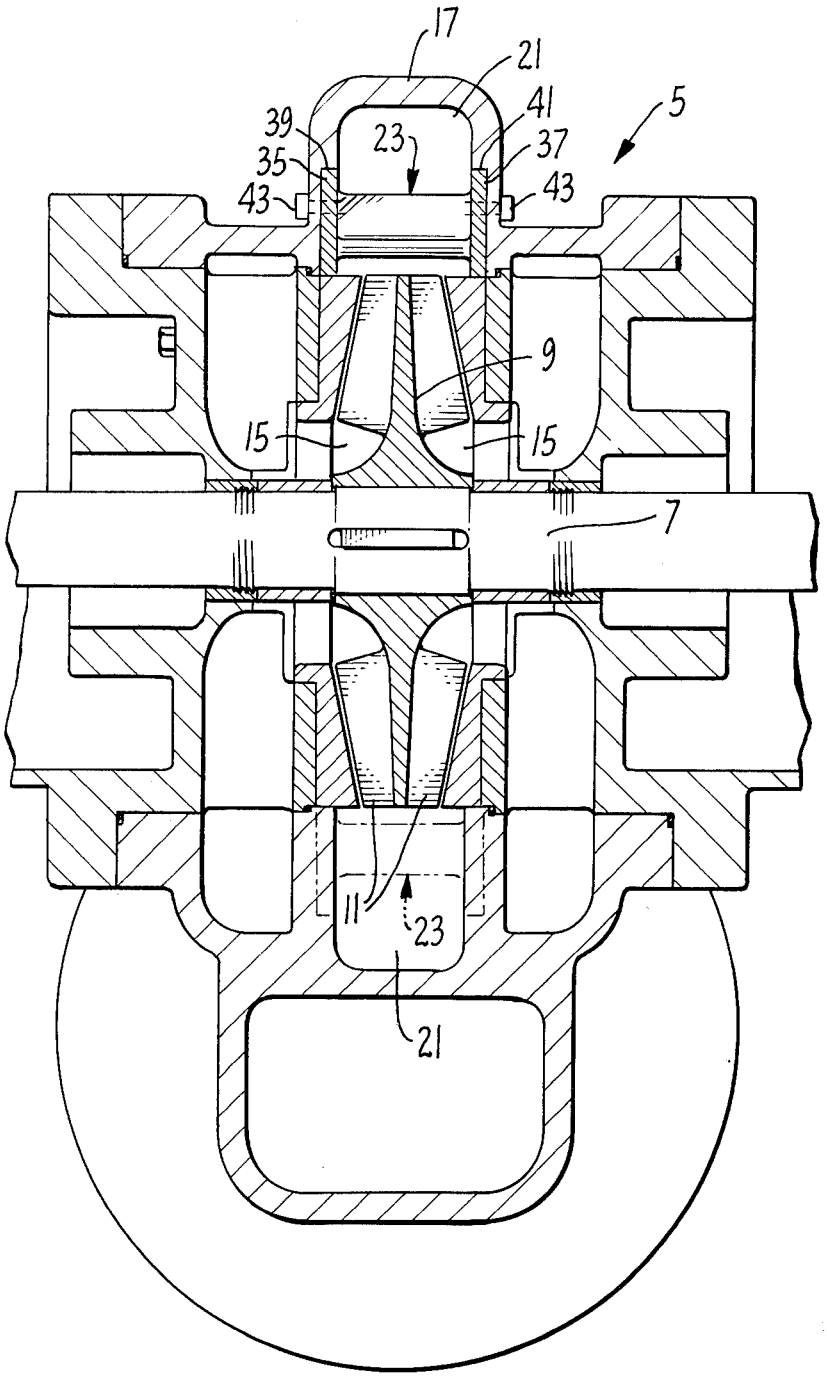
FIG. 4 is an enlarged section on line 4—4 of FIG. 1.

One of the replaceable lips which constitutes the gist of the present invention is shown in enlarged form in FIG. 3. Since the lips are identical, only one is described. The lip, generally designated 23, has a lower surface 25 which conforms to the shape of the inner surface of the inner casing 19. The lip proper, designated 27, is smoothly rounded at the point where the liquid leaves the impeller chamber and enters the volute. This leads to a ramp portion 29 which slopes gently to form a continuation of the outer surface of the inner casing 19. The back surface is rounded as at 31 to fit into a slot into the inner casing 19. The width of the lip 27 and ramp 29 are the same as the width of the throat of the volute. The side members 35 and 37 extend beyond the throat and fit into slots 39 and 41 milled in the outer casing 17. Bolts 43 are threaded into the holes 45 to hold the lip in place. The milled slots 39 and 41 completely contain the replaceable lip on the case side and there is only approximately 0.030 of an inch diametrical clearance between the inside radius of the lip and the outside diameter of the liners attached to the covers. Therefore, with this design, the volute lips are totally confined. The external bolting 43 is used for holding the lip in alignment with the double volute wall and also will withstand any pulsation stresses during operation. The number and size of these bolts is determined by calculation to suit the application as is well known to those skilled in the art. Other means may be employed to hold the lips in place.

It is apparent from the above, that since the replaceable part is relatively small, it can be made of materials which are highly resistant to abrasion and which would be too expensive or too difficult to fabricate if the entire pump casing were made of such a material. Thus, it is entirely possible to make the lip of a material which cannot be cast or machined by conventional methods such as ceramics, Stellite, plastics, sintered tungsten carbide or other materials.

Although a specific embodiment of the invention has been shown, it is obvious that many variations can be made from the exact structure shown without departing from the spirit of this invention. For instance, although the volute has double lips, the pump might have more or less replaceable lips.

I claim:

1. In combination with a pump having an impeller chamber and double volute passages formed by curved inner and outer casings and having a throat section, the inner casing having a free terminal tip which has defined therein a rounded slot extending transversely of the inner casing and the other casing having a pair of side walls with each side wall having a slot defined therein, the pump having an impeller chamber, a separate, replaceable volute lip mounted on the inner casing free terminal tip to be located in the volute throat section and comprising:

an integral central body;

a ramp portion on said body which has a curvature similar to that of the outer surface of the inner casing and a width equal to the width of the volute throat section;

a back surface on said body rounded to conform to the rounded slot in the outer casing to be received in that slot to mount the volute lip on the casing free terminal tip;

a front surface on said body rounded to define a lip member on said body; and a pair of identical side members each located on one side of said body and oriented to be esssentially perpendicular with a plane defined by said body, each of said side members having top and bottom edges which are curved and which intersect each other to form leading edges located forward of said lip member, said side memers each having a rear edge which is rounded to have a radius of curvature similar to that of said body rounded back surface, said side members each having a bolt receiving hole defined therein, said side members extending beyond said ramp to be located outside of the volute throat section to fit into the outer casing slots to position the lip member in the volute at a point where liquid in the pump leaves the impeller and enters the volute with the volute lip being totally confined by engagement of said side member within the outer casing slots, said side members each forming part of a corresponding outer casing side wall, said volute lip being separable from the volute casing to be replaceable thereon when worn without requiring replacement of the volute casing.

2. The structure of claim 1 wherein the pump has two replaceable lips.

3. The structure of claim 1 wherein the lip is further held in place with bolts passing through the outer casing and through said side member bolt holes.

4. The structure of claim 1 wherein the lip is made of a wear resistant material.

5. The replaceable volute lip defined in claim 6 wherein said side members extend above and below said ramp portion and form part of the outer casing wall above and below the said ramp.

* * * * *